US007692592B2

(12) United States Patent
Ly et al.

(10) Patent No.: US 7,692,592 B2
(45) Date of Patent: Apr. 6, 2010

(54) HIGH POWER TWO-PATCH ARRAY ANTENNA SYSTEM

(75) Inventors: Canh Ly, Laurel, MD (US); Steven J. Weiss, Silver Spring, MD (US); Arthur C. Harrison, Rockville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 124 days.

(21) Appl. No.: 12/178,771

(22) Filed: Jul. 24, 2008

(65) Prior Publication Data

US 2010/0019984 A1 Jan. 28, 2010

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 711, 846, 893
See application file for complete search history.

(56) References Cited

U.S. PATENT DOCUMENTS

| | | | | |
|---|---|---|---|---|
| 4,660,048 | A * | 4/1987 | Doyle | 343/700 MS |
| 5,165,109 | A * | 11/1992 | Han et al. | 343/700 MS |
| 7,538,735 | B2 * | 5/2009 | Crouch | 343/754 |
| 2008/0238781 | A1 * | 10/2008 | Su et al. | 343/700 MS |

OTHER PUBLICATIONS

Steven J. Weiss et al., "An Efficient Patch Antenna with Bandwidth Enhancement", IEEE, 2007, pp. 1529-1532.

* cited by examiner

*Primary Examiner*—Shih-Chao Chen
(74) *Attorney, Agent, or Firm*—A. David Spevack

(57) ABSTRACT

A patch array antenna is disclosed. The patch array antenna includes a ground plane with two patches. Each patch is supported from the ground plane only by metal posts. The patch array antenna further includes two-pin-feed probes, each pin-feed probe coupled to one patch, and a two-way high power divider attached to both pin-feed probes.

19 Claims, 6 Drawing Sheets

HIGH POWER TWO-PATCH ARRAY ANTENNA SYSTEM

GOVERNMENT INTEREST

The invention described herein may be manufactured, used and licensed by or for the U.S. Government.

BACKGROUND

1. Field of the Invention

The invention is in the field of patch antennas. More specifically, the invention is in the field of two-patch array antennas.

2. Background of the Invention

An antenna is an element used for radiating or receiving electromagnetic waves. While antennas are available in numerous different shapes and sizes, they all operate according to the same basic principles of electromagnetics.

As a general principle, a guided wave traveling along a transmission line in an antenna will radiate free-space waves also known as electromagnetic waves. Conversely, when an antenna is receiving, it transforms free-space waves by inducing a guided electromagnetic wave within a transmission line. The guided electromagnetic waves are fed into an integrated circuit, which converts them into a useful format.

When an antenna is transmitting, it receives the guided electromagnetic wave for transmission from a feed line and induces an electric field surrounding the antenna to form a free-space propagating electromagnetic wave. The features of an antenna can be described by parameters of operation such as frequency, radiation patterns, reflected loss, and gain.

An antenna may be a component of a device such as a cellular telephone, radio, television, or RADAR system that directs incoming and outgoing radio waves between free space and a transmission line. Antennas are usually composed of metal or polymers filled with metal or carbonaceous particles and have a wide variety of configurations, from the whip or mast-like devices employed for radio and television broadcasting to the large parabolic reflectors used to receive satellite signals and the radio waves generated by distant astronomical objects.

Many types of portable electronic devices, such as cellular phones, GPS receivers, palm electronic devices, pagers, laptop computers, and telematics units in vehicles, need an effective and efficient antenna for communicating wirelessly with other fixed or mobile communication units, including satellites. Advances in digital and radio electronics have resulted in the production of a new breed of personal communications equipment posing special problems for antenna designers.

Personal wireless communication devices have created an increased demand for compact antennas. The increase in satellite communication has also increased the demand for antennas that are compact and provide reliable transmission. In addition, the expansion of wireless local area has also necessitated the demand for antennas that are compact and inexpensive.

Wire antennas, such as whips and helical antennas, are sensitive to only one polarization direction. As a result, they are not optimal for use in portable communication devices which require robust communications even if the device is oriented such that the antenna is not aligned with a dominant polarization mode.

A patch antenna is a type of antenna that offers a low profile and easy manufacturability, great advantages over traditional antennas. Patch antennas are planar antennas used in wireless links and other microwave applications. They use patches formed on the top surface of a thin dielectric substrate separating them from a conductive layer on the bottom surface of the substrate that constitutes a ground for the transmission line or antenna.

Reflector or dish antennas are commonly used in residential environments for receiving broadcast services, such as television channel signals from geostationary, or equatorial, satellites. Reflector antennas, however, are bulky and relatively expensive for residential use. Furthermore, inherent in reflector antennas are feed spillover and aperture blockage by a feed assembly, which significantly reduces their aperture efficiency. An alternative antenna, such as a patch antenna, overcomes many of the disadvantages associated with reflector antennas.

Patch antennas require less space, are simpler and less expensive to manufacture, and are more compatible than reflector antennas. A parabolic reflector antenna has a curved surface. A patch antenna can be made having a planar surface. Further, a patch antenna can achieve the concentration of an antenna beam in a particular direction by means of the application of one of several methods.

Patch antennas are particularly suitable for use as active antennas. An active antenna is an antenna having all of the necessary components, such as an antenna element, feeding circuits, active devices or active circuits, integrally provided on a monolithic substrate, thus producing compact, low cost, and multi-function antenna equipment.

Additionally, the planar structure of a patch antenna permits it to be conformed to a variety of surfaces having different shapes. Patch antennas can be designed to produce a wide variety of patterns and polarizations, depending on the mode excited and the particular shape of the radiating element used. This results in the patch antenna being applicable to many military and commercial devices, such as use on aircraft or space antennas.

There is an increasing demand for the use of patch antennas in wireless communication due to their inherently low back radiation, ease of conformity and high gain as compared to wire antennas. The patch antenna design prevents large amounts of radiation from being produced at the back of the antenna.

Patch antennas comprise one or more conductive rectilinear or ellipsoidal patches supported relative to a ground plane and radiate in a direction substantially perpendicular to the ground plane. As opposed to a conventional wire-based antenna, the patch antenna comprises a plurality of generally planar layers including a radiating element, an intermediate dielectric layer, and a ground plane layer. The radiating element is an electrically conductive material imbedded or photo etched on the intermediate layer and is generally exposed to free space.

Depending on the characteristics of the transmitted electromagnetic energy desired, the radiating element may be square, rectangular, triangular, or circular and is separated from the ground plane layer. An exemplary patch antenna may include a transmission line feed, multiple dielectrics, and a metalized patch on one of the dielectrics. In a typical patch antenna, the radiator element is provided by a metallic patch that is fabricated onto a dielectric substrate over a ground plane.

The dual-band signal-layer patch antenna has been widely used in applications like radar and communication systems because of its advantages over a conventional antenna, such as lighter weight, lower profile and lower cost. Generally, dual-band single-layer patch antennas can be categorized into categories which include stub-type patch antennas, notchtype patch antennas, pin-and-capacitor-type patch antennas, and slot-loaded-type patch antennas.

The patch antenna has a very low profile and can be fabricated using photolithographic techniques. It is easily fabricated into linear or planar arrays and readily integrated with microwave integrated circuits. Patch antennas are commonly produced in half wavelength sizes, in which there are two primary radiating edges parallel to one another.

The performance of an antenna is determined by several parameters, one of which is efficiency. For a patch antenna, "efficiency" is defined as the power radiated divided by the power received by the input to the antenna. A one-hundred percent efficient antenna has zero power loss between the received power input and the radiated power output. Factors that determine patch antenna efficiency include the loss in the dielectric material, the surface wave loss, and conduction losses. Traditional patch antennas, designed with a dielectric material, have about 80% efficiency. For example, if the patch array antenna, designed on the dielectric, is excited with an input power of 1 kilowatt, the antenna will radiate 800 watts while 200 watts are lost.

Patch array antennas typically rely on traveling waves and require a complex feed network which contributes significant feed loss to the overall antenna loss. Furthermore, many patch antennas are limited to transmitting and/or receiving only a linearly polarized beam. The substrate is mounted on a larger ground plane, which serves as the return path for current induced on the patch element.

A patch antenna operates by resonating at a frequency. The patch antenna performs optimally when it is sized such that the cavity beneath the patch resonates in its fundamental mode at the frequency of interest.

Therefore, it is desirable for high power patch antennas to have high efficiency.

SUMMARY OF THE INVENTION

A high efficiency, high power two-patch array antenna system can be realized by suspending the patch above the ground plane by supporting metal posts. These elements are separated at prescribed distances and the metal posts are precisely located for obtaining electrical performance in terms of antenna pattern and gain. With such a configuration, the performance of the antenna system is equivalent to a much larger horn antenna The antenna's architecture is low profile and suitable for platform integration. The design is unique, reproducible, and affordable for manufacturing a low cost system.

DETAILED DESCRIPTION OF THE INVENTION

Figure 1:
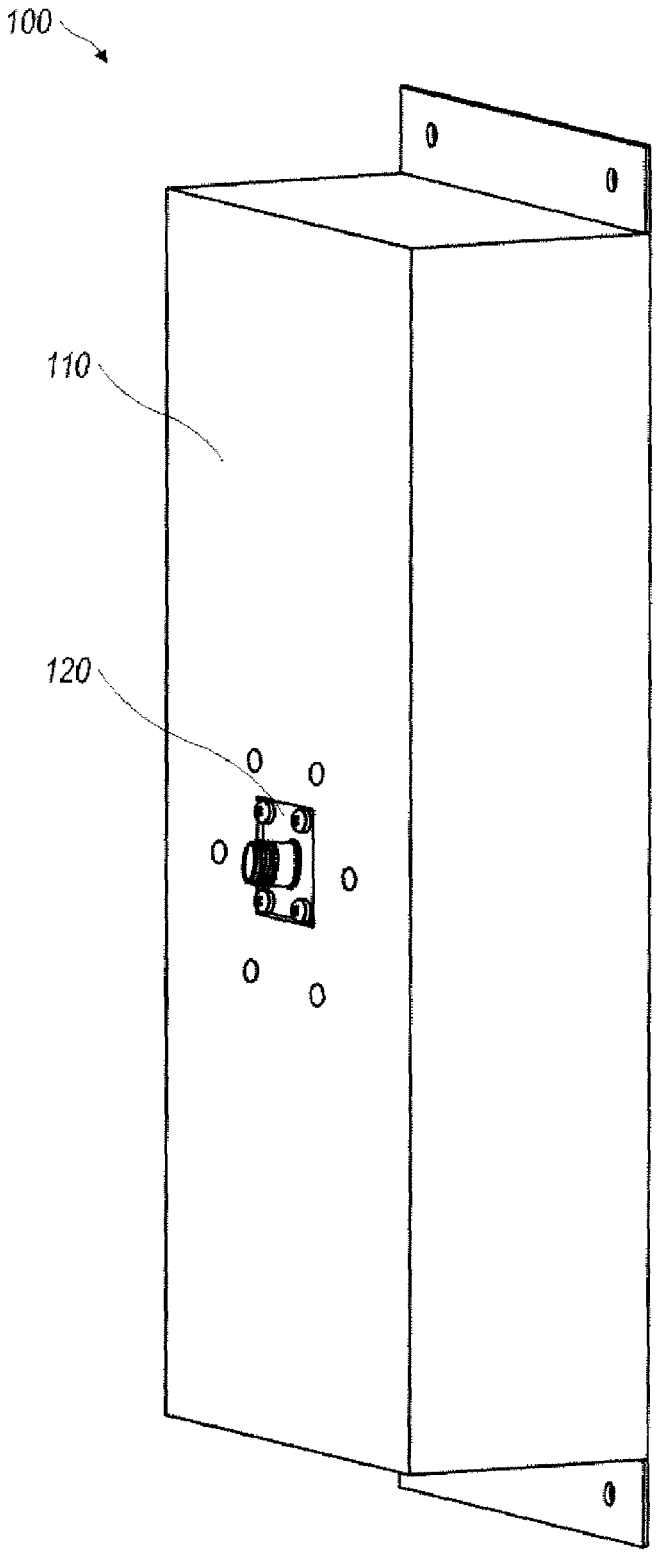
FIG. 1 is a back view of an antenna system of the present invention.
Figure 2:
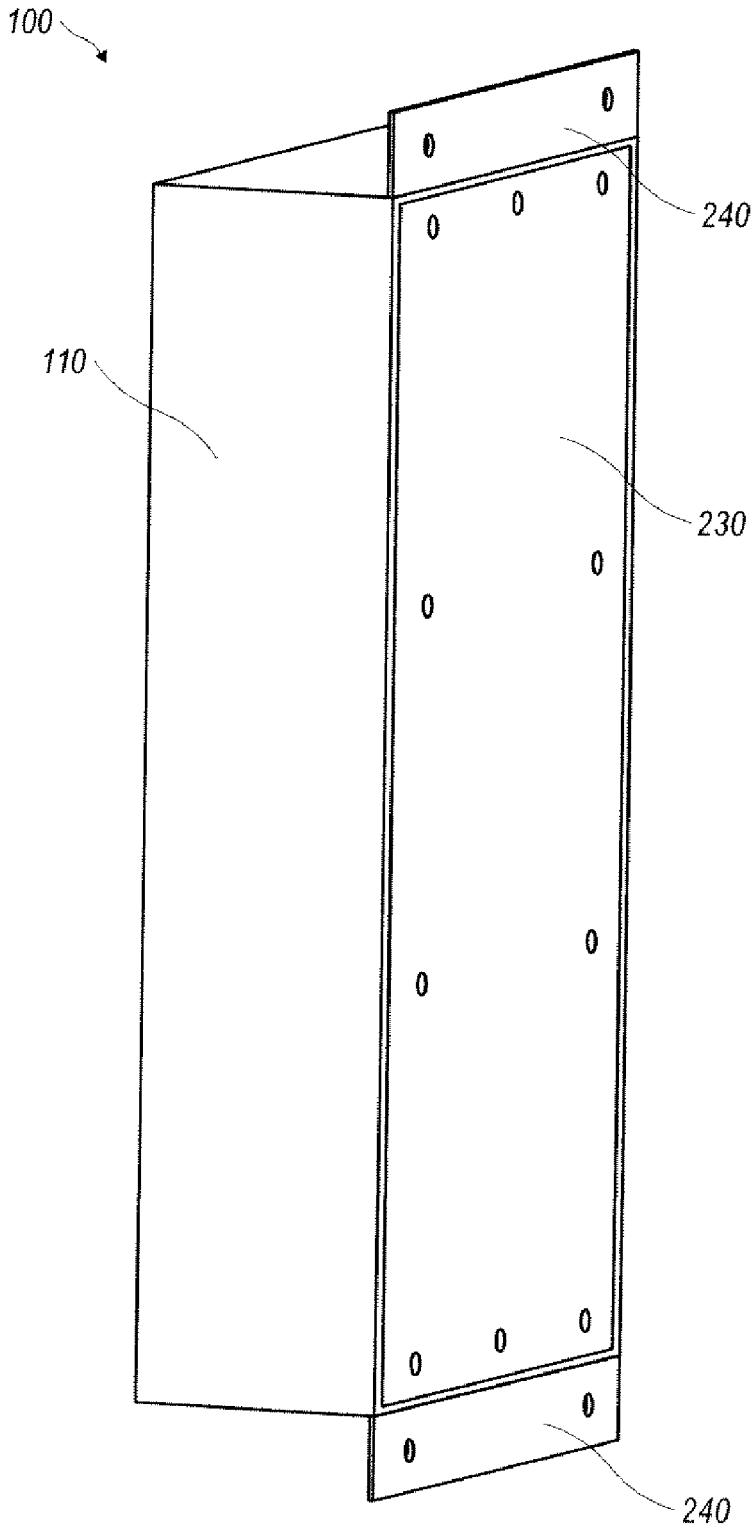
FIG. 2 is a front view of an antenna system of the present invention.

FIGS. 1 and 2 show the outside of the system 100. FIG. 1 is a back view of system 100. System 100 may include an outer cover 110. Outer cover 110 may include a hole through which a connector 120 may extend. Connector 120 may be able to be integrated with a high power RF (radio frequency) source. The high power RF source may be greater than 1 Kilowatt in power.

Outer cover 110 may enclose the other elements of system 100. Outer cover 110 may be of metal, plastic, or any other material capable of enclosing the other elements of system 100. Preferably, outer cover 110 is impervious to the environment.

FIG. 2 is a front view of system 100. System 100 may include an antenna cover 230. Antenna cover 230 is preferably made of a doped TEFLON® composition, e.g. DUROID® made by the Rogers Corporation. However, antenna cover 230 may be made of non-metallic material capable of enclosing the elements of system 100. Antenna cover 230 may be adapted to fit within outer cover 110. Outer cover 110 may include flanges 240. Flanges 240 may have a plurality of holes that allow system 100 to be mounted onto a platform.

Figure 3:
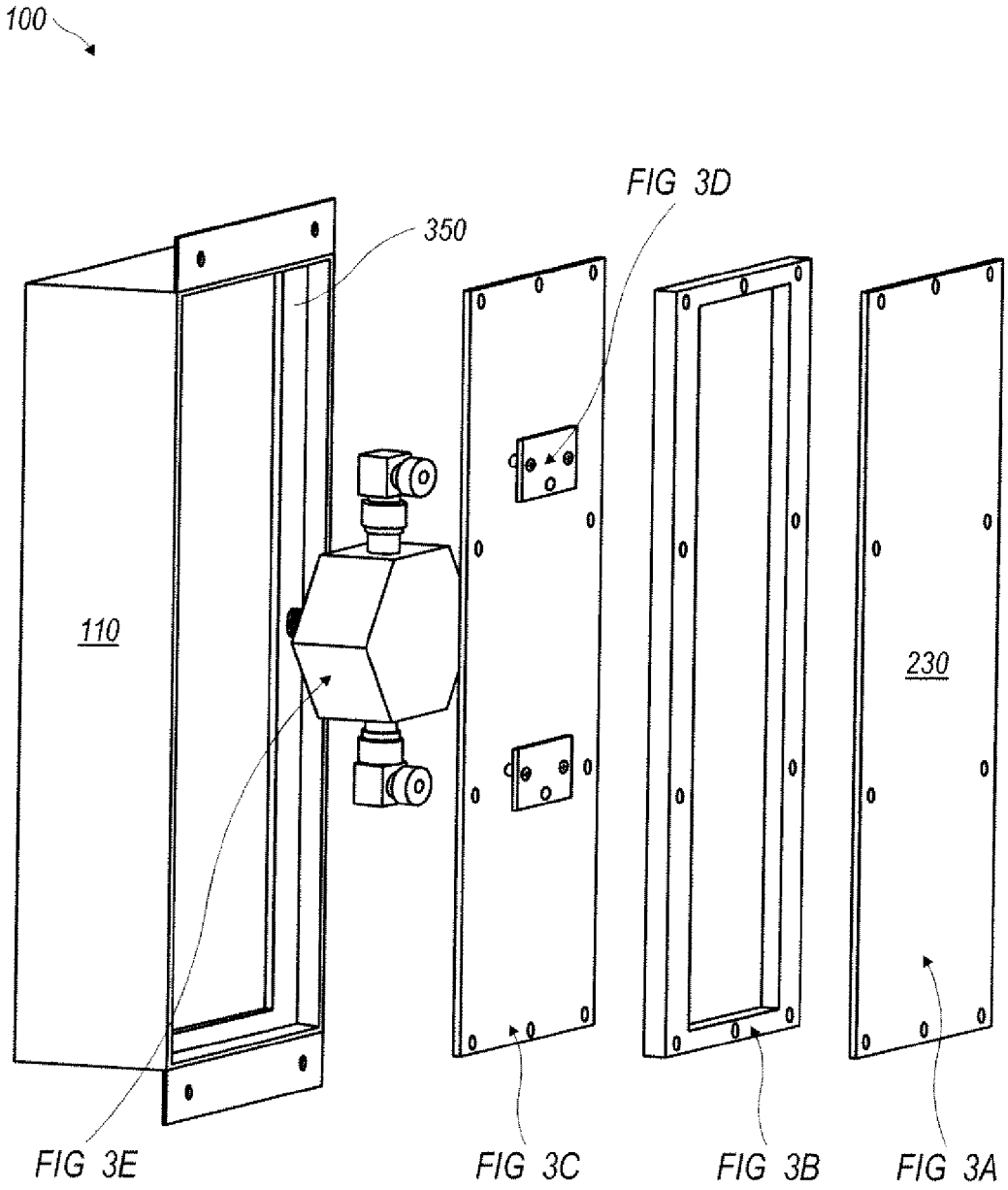
FIG. 3 is an exploded view of an antenna system of the present invention.

FIG. 3 is an exploded view of system 100. A two-way high power divider (described below with respect to FIG. 3*e*), a ground plane (described below with respect to FIG. 3*c*), two patches (described below with respect to FIG. 3*d*), and a spacer (described below with respect to FIG. 3*b*) are all sandwiched between outer cover 110 and antenna cover 230. A rim 350 running around the inner edge of outer cover 110 may hold all the elements in place.

Figure 3A:
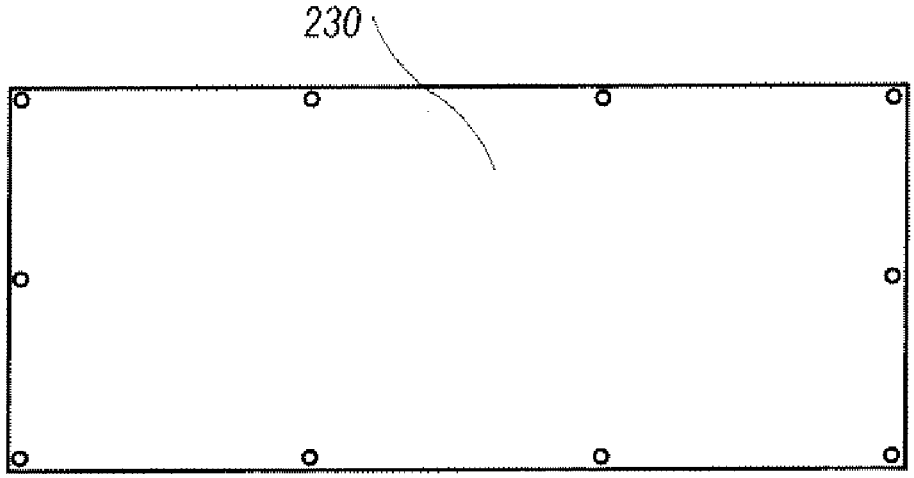
FIG. 3*a* is a schematic of the cover of an antenna system of the present invention.

FIG. 3*a* is a schematic of antenna cover 230. While specific dimensions are given in the figure, antenna cover 230 can be of any dimension or shape. Antenna cover 230 may be secured to outer cover 110 using screws, rivets, bolts or other fasteners through holes in antenna cover 230. While FIG. 3*a* shows 10 holes, any number of screw holes may be used. Additionally, antenna cover 230 may be secured to outer cover 110 via adhesive, clips, locking devices, or any other means known in the art. The seal between the antenna cover 230 and outer cover 110 may be air-tight and/or water-tight.

Figure 3B:
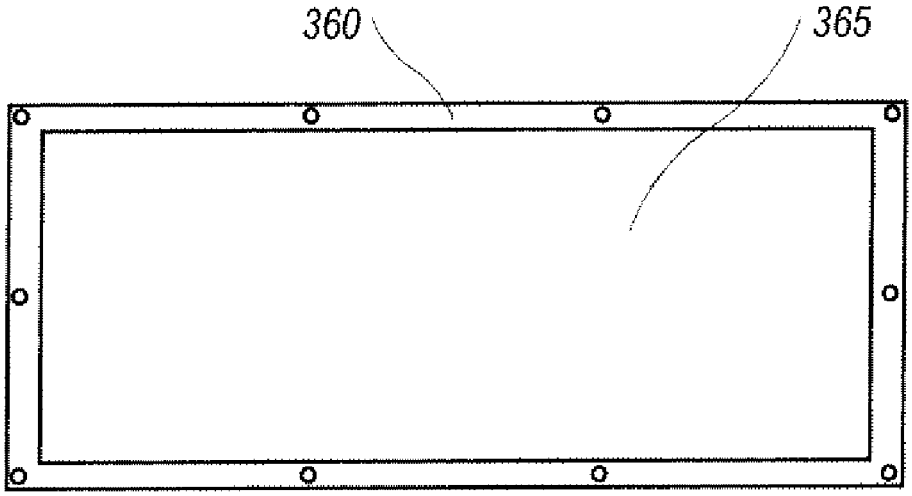
FIG. 3*b* is a schematic of the s pacer of an antenna system of the present invention.

FIG. 3*b* is a schematic of a spacer 360. While specific dimensions are given in the figure, spacer 360 can be of any dimension or shape. Spacer 360 may be secured between antenna cover 230 and outer cover 110 using screws, rivets, bolts or other fasteners through holes in spacer 360. While FIG. 3*b* shows 10 holes, any number of screw holes may be used. Spacer 360 is preferably made of a thermoplastic resin, such as a polycarbonate, e.g. as LEXAN® made by SABIC Innovative Plastics. However, spacer 360 can be made of any non-conducting material, including but not limited to plastics, glass, fibers, etc.

Spacer 360 is positioned between antenna cover 230 and ground plane 370. Spacer 360 has a void 365 in its center into which patches 380 may fit. Spacer 360 is preferably ½ inch high, however it can be of any height, including, but not limited to, ¼ inch, ⅓ inch, ⅔ inch, ¾ inch, and one inch. The height of spacer 360 may be chosen to minimize the loading effects of the dielectric cover on the patches.

Figure 3C:
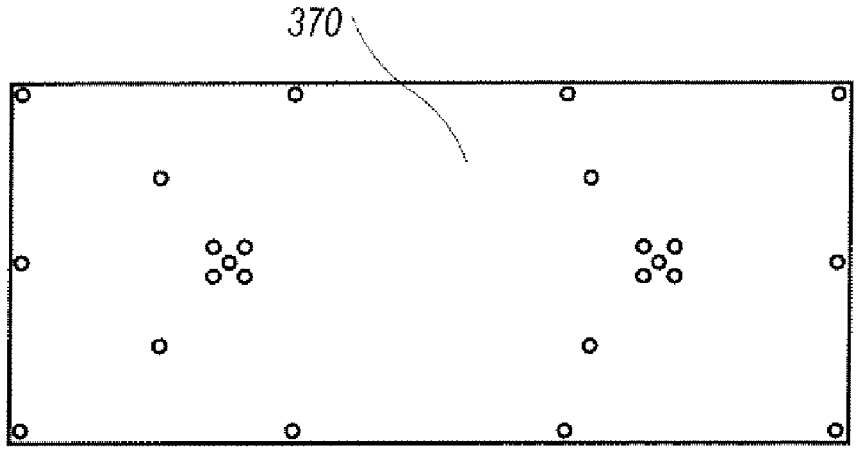
FIG. 3*c* is a schematic of the ground plane of an antenna system of the present invention.

FIG. 3*c* is a schematic of ground plate 370. While specific dimensions are given in the figure, as exemplary of the best mode know to the inventor, ground plate 370 can be of any dimension or shape. Ground plate 370 may be secured between antenna cover 230 and outer cover 110 using screws or bolts through holes in ground plate 370. While FIG. 3*b* shows 10 screw holes, any number of screw holes may be used. Ground plate 370 may be made of any conducting material. Ground plane 370 supports two patches 380.

Figure 3D:
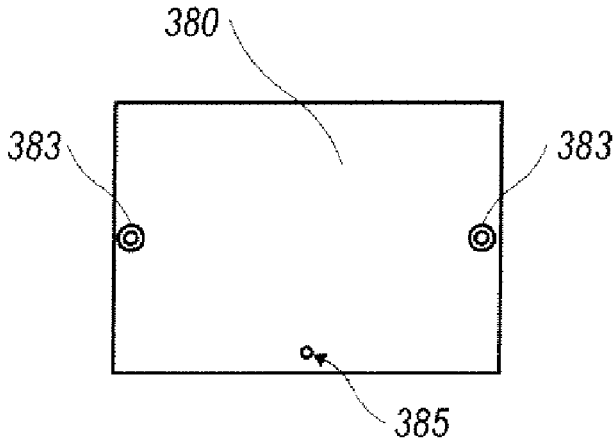
FIG. 3*d* is schematics of a patch of an antenna system of the present invention.

FIG. 3*d* is a schematic of patches 380. Patches 380 may be supported from ground plane 370 by posts. Preferably, each patch 380 may be supported by two posts located at positions 383. However any number of posts may be used to support patch 380. The posts may be made of metal, plastic or any other materials know in the art. Furthermore, the posts may be held in place by bolts, clips, adhesive, or any other method known in the art. Additionally, each patch 380 may be coupled to a pin-feed probe. Pin-feed probes excite patches 380 and may be coupled adjacent to an edge of patch 380 other than locations 383, such as location 385.

Patches 380 are preferably separated by a distance of 1.27864λ, where λ is the operating wavelength of system 100. However, patches 380 may be separated by any distance, including, but not limited to, 1λ, 1.1λ, 1.2λ, 1.3λ, 1.4λ, and 1.5λ. Furthermore, patches 380 may be placed at a location separated from spacer 360.

Figure 3E:
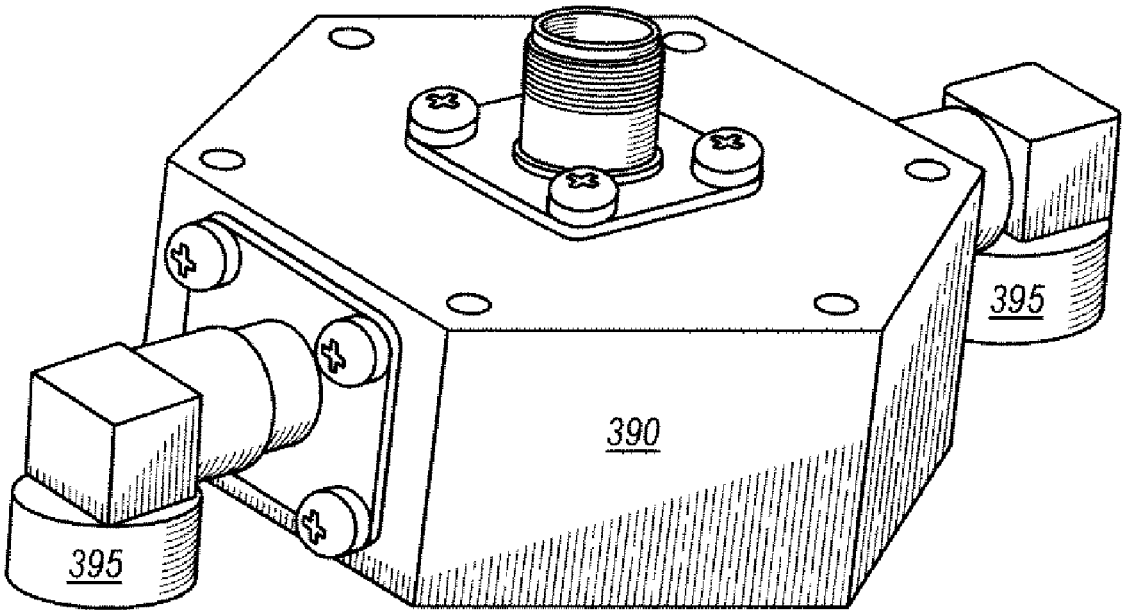
FIG. 3*e* depicts a commercial two-way high power divider with two right angle male-to-male connectors.

FIG. 3*e* is an image of a two-way high power divider 390 with two right angle male-to-male connectors 395. The connectors 395 are connected to the pin-feed probes coupled to each patch 380, It should be apparent that embodiments other than those specifically described above may come within the spirit and scope of the present invention. Hence, the present invention is not limited by the above description.

The invention claimed is:

1. A patch array antenna, comprising:

a ground plane;

two patches, each patch supported from the ground plane only by a plurality of metal posts;

two pin-feed probes, each pin-feed probe coupled to one patch; and a two-way high power divider coupled to both pin-feed probes.

2. The patch array antenna of claim 1, further comprising:

an outer cover;

an antenna cover coupled to the outer cover; and an insulating spacer, wherein the insulating spacer surrounds the two patches and separates the ground plane from the antenna cover.

3. The patch array antenna of claim 1, wherein the two patches are spaced 1.27864λ apart, wherein λ is the operating wavelength of the system.

4. The patch array antenna of claim 1, wherein each patch is supported from the ground plane by two metal posts.

5. The patch array antenna of claim 4, wherein each metal post is located adjacent to one opposite, parallel edge of the patch.

6. The patch array antenna of claim 4, wherein the pin-feed probe is coupled to the patch adjacent to a third edge of the patch.

7. The patch array antenna of claim 1, wherein the pin-feed probe excites the patch.

8. A mountable antenna system, comprising:

a ground plane;

two patches, each patch supported from the ground plane only by a plurality of metal posts;

two pin-feed probes, each pin-feed probe coupled to one patch;

a two-way high power divider coupled to both pin-feed probes; and an outer container to encase the ground plane, the two patches, the two pin-feed probes, and the two-way high power divider.

9. The mountable antenna system of claim 8, wherein the system is mounted to an automotive vehicle.

10. The mountable antenna system of claim 8, wherein the system is mounted to a marine vehicle.

11. The mountable antenna system of claim 8, wherein the system is mounted to an aeronautical vehicle.

12. The mountable antenna system of claim 8, wherein the system is mounted to an aerospace vehicle.

13. The mountable antenna system of claim 8, wherein the system is mounted to an amphibious vehicle.

14. The mountable antenna system of claim 8, wherein the system is mounted to a satellite.

15. The mountable antenna system of claim 8, wherein the system is mounted to a portable electronic device.

16. The mountable antenna system of claim 8, wherein the system is mounted to a building.

17. The mountable antenna system of claim 8, wherein the outer container has mounting flanges to mount the antenna.

18. The mountable antenna system of claim 8, further comprising an insulating spacer, wherein the insulating spacer surrounds the two patches and separates the ground plane from the outer container.

19. The mountable antenna system of claim 8, wherein the outer container is comprised of:

an outer cover; and an antenna cover coupled to the outer cover.

* * * * *